US005628718A

United States Patent [19]

Huober

[11] Patent Number: 5,628,718

[45] Date of Patent: May 13, 1997

[54] METHOD OF OPERATING A FOLDER

[75] Inventor: Bodo Huober, Ludwigsburg, Germany

[73] Assignee: Stahl GmbH & Co. Maschinenfabrik, Neckarweilhingn, Germany

[21] Appl. No.: 362,535

[22] PCT Filed: May 6, 1994

[86] PCT No.: PCT/EP94/01462

§ 371 Date: Jan. 5, 1995

§ 102(e) Date: Jan. 5, 1995

[87] PCT Pub. No.: WO94/26644

PCT Pub. Date: Nov. 24, 1994

[30] Foreign Application Priority Data

May 6, 1993 [DE] Germany ..... 43 15 095.0

[51] Int. Cl.[6] ..... B31B 1/02; B65H 45/12; B65H 45/18

[52] U.S. Cl. ..... 493/29; 463/23; 463/417

[58] Field of Search ..... 493/3, 8, 9, 10, 493/23, 29, 405, 415, 416, 417, 419, 424, 434, 437, 444, 443

[56] References Cited

U.S. PATENT DOCUMENTS

| | | | |
|---|---|---|---|
| 3,176,977 | 4/1965 | Graf | 270/77 |
| 4,085,928 | 4/1978 | Sussman | 493/405 |
| 4,175,740 | 11/1979 | Klenk | 270/83 |
| 4,338,086 | 7/1982 | Heater | 493/419 |
| 4,419,088 | 12/1983 | Nemec | 493/444 |
| 4,425,110 | 1/1984 | Gruger | 493/444 |
| 4,481,007 | 11/1984 | Hornung | 493/444 |
| 4,496,337 | 1/1985 | Meenen | 493/23 |
| 4,573,671 | 3/1986 | Reponty | 493/23 |
| 4,578,052 | 3/1986 | Engel | 493/417 |
| 4,746,108 | 5/1988 | Hirayama | 493/437 |

FOREIGN PATENT DOCUMENTS

| | | | |
|---|---|---|---|
| 0131310A1 | 7/1984 | European Pat. Off. | B65H 45/12 |
| 3935056A1 | 6/1991 | Germany | B65H 45/18 |

OTHER PUBLICATIONS

Folding in Practice, Alfred Furler, 1983, pp. 40–44.

*Primary Examiner*—Joseph J. Hail, III
*Assistant Examiner*—Christopher W. Day
*Attorney, Agent, or Firm*—Frost & Jacobs

[57] ABSTRACT

A method of operating a folder comprising a plurality of sequentially arranged folding units. At least one folding unit is provided with a sheet detector arranged upstream of a sheet abutment and at least one lateral guide. Apart from automatic and single stroke modes of operation, a further mode of operation for the set-up or "make-ready" of the folder is provided, in which (1) the drive of the folder is run at a reduced speed within a predetermined speed range, for example, 50–60 m/min.; (2) upon detecting a supplied sheet, the sheet detector supplies a switch "off" signal to the drive so that the sheet movement is retarded short of the guide of the respective folder unit and comes to rest; (3) the sheet is then moved at a further-reduced speed toward the sheet abutment of the respective folder unit; and (4) in a phase between a stationary state of the sheet until the sheet arrives at the sheet abutment, the guide is set to suit the size and folding shape requirements of the supplied sheet.

24 Claims, 2 Drawing Sheets

METHOD OF OPERATING A FOLDER

TECHNICAL FIELD

The invention relates to a method of operating a folder comprising a plurality of sequentially arranged folder units, of which at least one is provided with a sheet detector arranged upstream of a sheet abutment and at least one lateral guide, in which automatic and single stroke modes of operation are provided for.

BACKGROUND OF THE INVENTION

In a folder the sheet abutments and guides must be set to the size of the respective sheet to be folder at the start of a run. The setting up of a new run is, however, a very slow process. Depending upon the speed of the conveyor tapes, the controller of the folder must determine when the conveying means must be switched off (i.e., at an earlier or later point in time) if the sheets being supplied to the folder are to come to rest at the correct position underneath the chopper in order to perform adjustment of the abutments and guides.

SUMMARY OF THE INVENTION

One object of the invention is to provide a method of operating a folder of the type initially mentioned by which the setting of the sheet guides is simplified.

This aim is to be achieved in accordance with the invention by the provision of a further mode of operation for setting up the machine in a "make-ready" mode, in which:

- the drive of the machine is run at a reduced speed within a predetermined speed range,
- on detecting a supplied sheet, the sheet detector supplies a switch off signal for the drive so that the sheet is retarded short of the guide of the respective folder unit and comes to rest;
- the sheet is then moved at a further-reduced speed toward the sheet abutment of the respective folder unit; and
- in a phase between a stationary state of the sheet and until the sheet arrives at the sheet abutment, the guide is set to suit the size and folding requirements of the supplied sheet.

The invention is applicable to folders having chopper or knife-folding units as well as to folders having buckle (or buckle-plate) folding units, and more particularly to combination folders (i.e., "combination folders" are folders having in combination both knife-folding units and buckle plate-folding units) having knife-folding units for forming right-angled folds, three-directional folds and four-directional folds, and to buckle folders having folding units for forming right-angled folds, three-directional folds, and four-directional folds, respectively.

The European patent publication 0 131 310 A discloses a prior art folder with chopper folder (i.e., knife-folder) units, which possesses a sheet detector that registers the passage of a sheet to be folded that is located on the conveyor tapes. The distance of the sheet detector from the abutment is made such that a sheet ready to be folded at the abutment is no longer in the working range of the sheet detector. A controller for the drive of the conveyor tapes stops this drive if an approaching sheet detected by the sheet detector has not left the working range of the sheet detector after a set time has elapsed after the first instant of sheet detection. In accordance with the method of the invention the same sheet detector may be employed to produce a switch off signal to the drive in the "make-ready" mode of operation.

In the case of another prior art folder in accordance with the German patent publication 3,935,056 A, the individual buckle-plate folder units possess different associated sheet detectors. Such a folder (as well a folder using the method of the present invention) can be utilized in which the signals of the sheet detectors can be used as "switch off" signals for the "make-ready" or "set up" mode of operation.

Advantageous further developments of the invention include manually powering the folder at a further reduced speed, thereby causing the movement of the sheet toward the sheet abutment. In addition, this movement of the sheet toward the sheet abutment can be caused, at a much reduced speed, by repeated short-time operations of a switch for the temporary operation of the drive of the folder. Furthermore, in certain folder units, a "make-ready" or "set-up" mode of operation is individually provided using a single stroke mode of operation. After selection of the single stroke mode of operation has occurred, the make-ready mode of operation is available, which involves the take up of a sheet from a sheet delivery point by operation of a start-stop switch.

The drive of the folder in put into operation, after setting a lateral guide device, by actuating the start-stop switch. The sheet is then moved on the conveyor at the reduced speed from the sheet abutment and until the sheet reaches the following folder unit. If the single-stroke operation mode has been selected for a particular folder unit, the sheet movement is arrested at the guide of the following folder unit for adjustment of the guide. The folder typically includes an inverter drive and an electronic control system, and can operate at a speed in the range of approximately fifty (50) to sixty (60) m/min.

Further advantageous developments and convenient forms of the invention will be understood from the following a detailed descriptive disclosure of one embodiment thereof in conjunction with the accompanying drawings.

DETAILED DESCRIPTION OF THE PREFERRED EMBODIMENT

Figure 1:
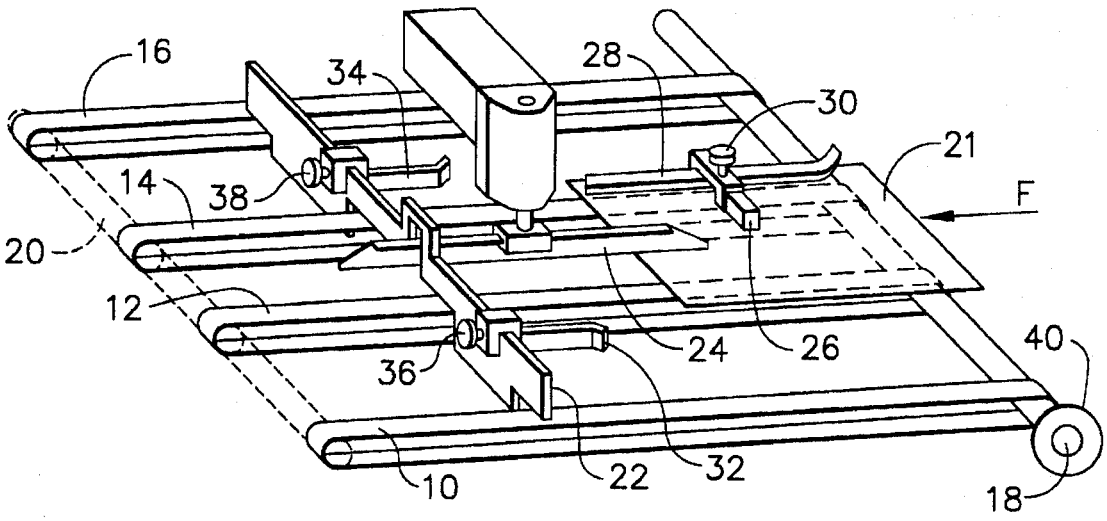
FIG. 1 is a diagrammatic perspective representation of the main elements of a chopper folder unit indicating the relative arrangement of a sheet detector and the sheet guides.

In the folder mechanism diagrammatically illustrated in FIG. 1, forming part of a chopper folder, there are four parallel conveyor tapes 10, 12, 14 and 16, which run on two mutually parallel, spaced rolls 18 and 20 and are driven by at least one thereof. The roll 20 is indicated in dashed lines in the drawing. The sheet 21 to be folded is moved by the conveyor tapes 10, 12, 14 and 16 in the direction of the arrow "F" toward an abutment 22, which is arranged substantially perpendicular to the conveying direction F. A folding chopper 24 cooperates with a folding roll (not illustrated), which is placed underneath the conveyor tapes 10, 12, 14 and 16, said chopper 24 being arranged in parallel to these conveyor tapes 10, 12, 14 and 16 and between the conveyor tapes 10, 12, 14, and 16. This folding chopper 24 is provided with a means for moving it upward and downward. Its upward and downward motion is timed by a folding chopper timing unit (not illustrated).

A sheet detector 26, which has the purpose of registering the passage of a sheet 21, is adjustably arranged on a rail 28, which extends in parallel to the conveyor tapes 10, 12, 14 and 16, so that the distance between the sheet detector 26 and the abutment 22 can be set. In order to fix the sheet detector 26, which is preferably a photoelectric detector, on the rail 28, a set screw 30 is employed.

On the abutment 22, two respective adjustable sheet guides 32 and 34 are provided. The sheet guides 32 and 34 are able to be locked in place on the abutment 22 by means of set screws 36 and 38.

The folder of FIG. 1 possesses a drive at roll 18 with an inverter speed control system 50 (see FIG. 2) and may be operated at a variable speed. It is further provided with an electronic controller 52 (see FIG. 2).

This electronic controller 52 is applicable to machines with an inverter drive 50, with which there is a possibility of performing a more rapid and more exact setting of the lateral sheet abutments to suit the supplied sheet during a "set-up" or "make-ready" function on combination machines that include right angle folds.

At the present time the controls of prior art combination folders are such that, apart from the select switch for automatic and individual stroke operation (where right angle, three and four folds are controlled using separate switches), there is no exact way of correctly setting the lateral sheet guides short of the right angle fold abutment. Depending on the speed of the machine, it is necessary to switch off the drive in advance at a particular moment using the machine stop button, if the supplied sheet is to come to a halt underneath the chopper at a favorable position in order to set the respective abutments. Timely switching off is therefore dependent on the person performing the set-up, or make-ready procedure.

In the case of machines with an inverter drive the possibility of a "make-ready" function now becomes possible using the present invention.

Right angle fold setting:

Using the right angle fold select switch 58 (preferably mounted on a control panel 54) for both automatic and single stroke operation (see step 100 on FIG. 3), the "single stroke" setting (i.e., using a single stroke switch 62) also provides for the "make-ready" function for a right angle fold (see step 102). As used herein, the term "automatic" operation refers to a mode in which the folder is operated continuously, and the term "single stroke" operation refers to a mode in which the folder is fed only a single sheet 21 to be folded, in order to control and adjust the folder. The term "make-ready" operation refers to a mode in which an operator correctly sets various guides of the folder in order to obtain correct folding of the supplied sheets.

Figure 3:
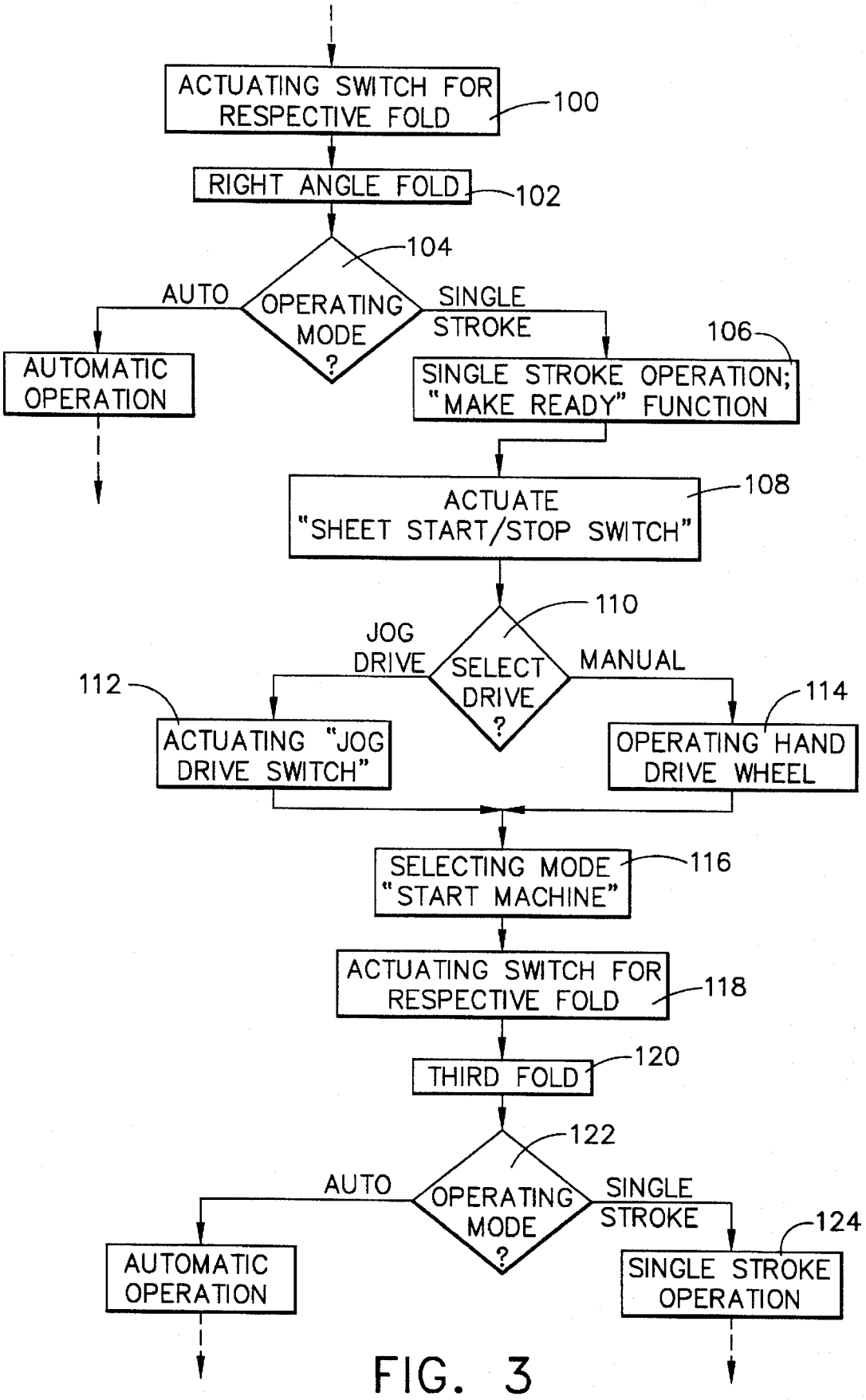
FIG. 3 is a flow chart of the major steps taken to set-up a right angle fold using a single stroke operation and the "make-ready" function of the present invention.

In this mode the drive 50 is set for a fixed machine speed of between fifty (50) and sixty (60) m/min, so that the start speed becomes set to a speed between 50–60 m/min. using the select switch 58 to get single stroke operation at decision block 104 on FIG. 3. Using the "sheet start/stop" switch 56 at step 108, the next sheet 21 is taken from the delivery point, and the sheet runs through the roll array (parallel folding unit) on its way to the right angle photoelectric switch 26. This photoelectric switch may be in accordance with the prior art and is described in the European patent publication 0 131 310 A. Such photoelectric switch is responsible for the further function of set-up or "make-ready" of step 106. When the leading edge of the new sheet reaches such photoelectric switch 26, a signal is produced which arrests and brakes the machine in such a manner that the sheet comes to a halt short of the lateral sheet guides 32 and 34, i.e., in just the right make-ready position for the user. Using the "jog drive" switch 60 at step 112, the sheet 21 can be moved at approximately five m/min to the sheet abutment 22 and the position of the lateral sheet guide while being visually checked. It will be understood that the use of jog drive switch 60 may well not be one continuous actuation by a set-up operator, but may instead consist of repeated, short-term actuations to bring the sheet 21 into the proper position. Alternatively using decision block 110, this operation may be performed using the hand drive wheel 40 at step 114 on the parallel fold unit. Once the lateral sheet guides 32 and 34 have been set, using the mode "start machine" at step 116, (at 50–60 m/min) and operating the single stroke switch 62 with the "single stroke third fold" setting of the select switch 58 at step 118, the sheet 21 abutting the right angle fold abutment can be further passed on for making a subsequent or third fold of a common folder, at step 120.

The signal from the third fold photoelectric switch (same function as for right angle fold—not illustrated) arrests and brakes the machine and the sheet is again in a position suitable for making set-up, or make-ready adjustments of the various guides using decision block 122, as is the case with a right angle fold. In the "single stroke third fold" setting of the select switch 58 at step 124, a sheet is taken from the delivery point and it then runs along the roll array (parallel fold) through the right angle fold unit, and only stops in the third fold unit in the optimal position for set-up or make-ready. The function of the subsequent fourth fold adjustment is similar to that of the right angle and third folds.

The control system 52 is advantageous for the user and saves him time, and is also applicable to buckle folders with two, three, and four folding units.

In the set-up or "make-ready" function, the drive 50 in the "start machine" setting is set for a constant speed, as is the case with a combination folder. For instance the sensor B1 (as in the German patent publication 3,935,056), arranged on the sheet guide of the oblique roll table of the second station, produces a signal so that the machine stops and slows down. The sheet 21 remains lying on the oblique roll table and adjustments may be performed.

In the "start folder" setting, the sheet 21 then goes through the second station at the permanently set speed. The third and fourth folding units possess the same function as the second folding unit.

The selected, permanently set make-ready speed of 50–60 m/min offers the advantage that, at such speeds hardly any re-adjustment of the buckle fold will be necessary for the parallel fold. At a lower speed, achieved for example by manually powering the folder such as by use of the hand drive wheel 40, to move the sheet into the buckle folding unit, substantial re-adjustment will be necessary when the folder is switched over to automatic operation (i.e. at the full speed).

The chopper folding unit illustrated in FIG. 1 shows the situation of the sheet 21 entering the folder in the stop position. The leading edge of the sheet has moved past the photoelectric switch 26 which provides a signal to arrest and brake the folder so that the sheet halts at a proper adjustment position short of the lateral sheet guides 32 and 34. Using the jog drive or powering the folder by hand at roll 18, the sheet can be moved as far as the sheet abutment 22, and the lateral sheet guides then may be exactly set.

Figure 2:
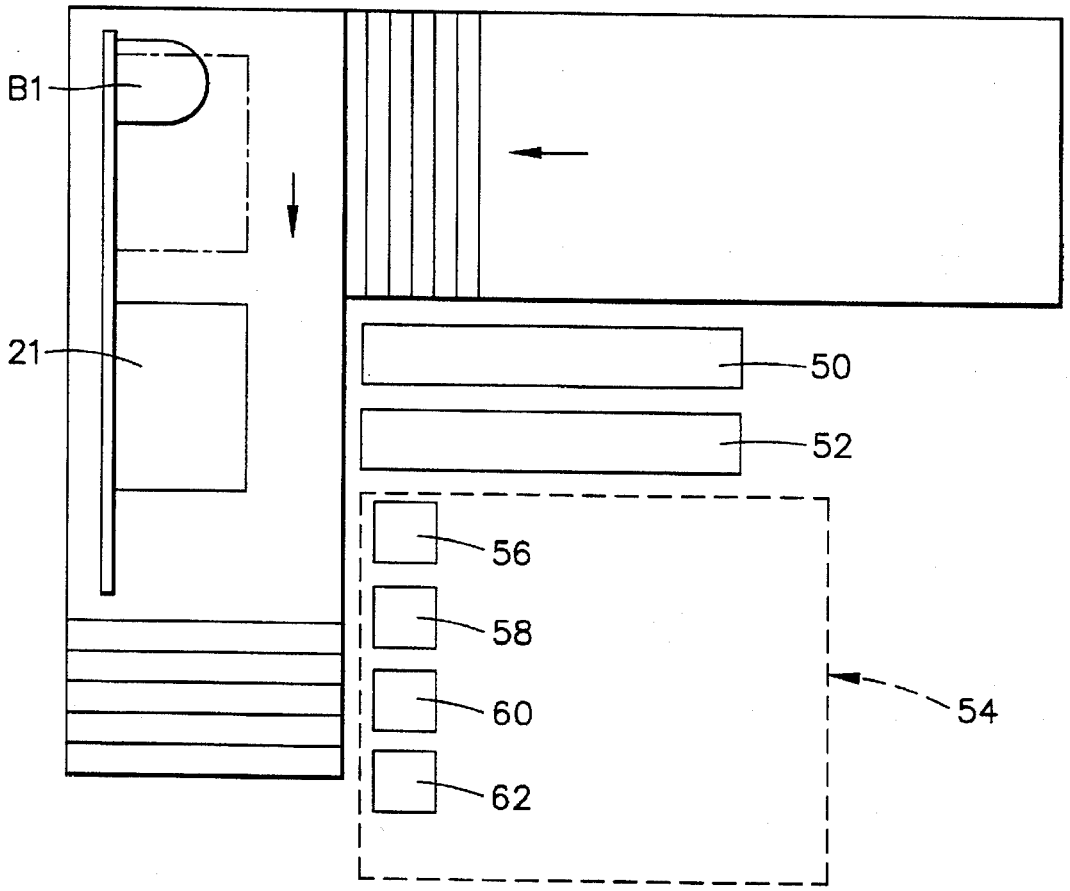
FIG. 2 is a diagrammatic lateral elevation view of part of a buckle folder, in which the sheet detector is arranged adjacent to the second folder mechanism.

The buckle folder depicted in FIG. 2 is shown with the sheet 21 in the stop position, set using the photoelectric switch B1, which has been previously passed by the leading edge of the sheet.

What is claimed is:

1. A method of operating a folder comprising a plurality of sequentially arranged folding units, of which at least one folding unit is provided with a sheet detector arranged upstream of a sheet abutment and at least one substantially lateral guide, wherein automatic and single stroke modes of operation are provided, characterized by the provision of a further mode of operation for make-ready of the folder, wherein:

a drive of the folder is run at a reduced speed within a predetermined speed range;

upon detecting a supplied sheet the sheet detector supplies a switch off signal for the drive so that the sheet is retarded short of the guide of the respective folding unit and comes to rest;

the sheet is then moved at a further-reduced speed toward the sheet abutment of the respective folding unit; and in a phase between a stationary state of the sheet and the sheet's arrival at the sheet abutment, the guide is set to suit the supplied sheet's requirements.

2. The method as claimed in claim 1, characterized in that movement of the sheet toward the sheet abutment is caused by manually operating the folder at a further-reduced speed.

3. The method as claimed in claim 2, characterized in that, at least in certain folding units thereof, said make-ready mode of operation is respectively individually provided for using a single stroke mode of operation.

4. The method as claimed in claim 2, characterized in that the folder comprises an inverter drive and an electronic control system.

5. The method as claimed in claim 2, characterized in that the folder operates at a predetermined speed range of approximately 50 to 60 m/min.

6. The method as claimed in claim 1, characterized in that movement of the sheet toward the sheet abutment is caused at a further much-reduced speed by repeated, short-time operation of a switch for temporary operation of the drive of the folder.

7. The method as claimed in claim 6, characterized in that, at least in certain folding units thereof, said make-ready mode of operation is respectively individually provided for using a single stroke mode of operation.

8. The method as claimed in claim 6, characterized in that the folder comprises an inverter drive and an electronic control system.

9. The method as claimed in claim 6, characterized in that the folder operates at a predetermined speed range of approximately 50 to 60 m/min.

10. The method as claimed in claim 1, characterized in that, at least in certain folding units thereof, said make-ready mode of operation is respectively individually provided for using a single stroke mode of operation.

11. The method as claimed in claim 10, characterized in that, after selection of a single stroke mode of operation, the make-ready mode of operation is set, involving take up of a sheet from a sheet delivery point by operation of a start-stop switch.

12. The method as claimed in claim 10, characterized in that the folder comprises an inverter drive and an electronic control system.

13. The method as claimed in claim 10, characterized in that the folder operates at a predetermined speed range of approximately 50 to 60 m/min.

14. The method as claimed in claim 11, characterized in that, after setting said at least one substantially lateral guide, the drive of the folder is put into operation by actuating a start-stop switch, after which the sheet is moved at said reduced speed downstream from the sheet abutment as far as a following folding unit.

15. The method as claimed in claim 11, characterized in that the folder comprises an inverter drive and an electronic control system.

16. The method as claimed in claim 11, characterized in that the folder operates at a predetermined speed range of approximately 50 to 60 m/min.

17. The method as claimed in claim 14, characterized in that movement of the sheet is arrested at the guide of said following folding unit to perform adjustment of said guide when the single stroke operation mode has been selected for such folding unit.

18. The method as claimed in claim 14, characterized in that the folder comprises an inverter drive and an electronic control system.

19. The method as claimed in claim 14, characterized in that the folder operates at a predetermined speed range of approximately 50 to 60 m/min.

20. The method as claimed in claim 17, characterized in that the folder comprises an inverter drive and an electronic control system.

21. The method as claimed in claim 17, characterized in that the folder operates at a predetermined speed range of approximately 50 to 60 m/min.

22. The method as claimed in claim 1, characterized in that the folder comprises an inverter drive and an electronic control system.

23. The method as claimed in claim 22, characterized in that the folder operates at a predetermined speed range of approximately 50 to 60 m/min.

24. The method as claimed in claim 1, characterized in that the folder operates at a predetermined speed range of approximately 50 to 60 m/min.

* * * * *